US012710245B2

(12) United States Patent
Spicer et al.

(10) Patent No.: US 12,710,245 B2
(45) Date of Patent: Aug. 18, 2026

(54) PROJECTILE LOADER LOCKING AND OPERATION MECHANISMS

(71) Applicant: Kore Outdoor (US) Inc., Fort Wayne, IN (US)

(72) Inventors: Louis Spicer, Sewell, NJ (US); Robert Ambrose, Marlton, NJ (US)

(73) Assignee: Kore Outdoor (US) Inc., Fort Wayne, IN (US)

( * ) Notice: Subject to any disclaimer, the term of this patent is extended or adjusted under 35 U.S.C. 154(b) by 206 days.

(21) Appl. No.: 18/226,582

(22) Filed: Jul. 26, 2023

(65) Prior Publication Data

US 2025/0035403 A1 Jan. 30, 2025

(51) Int. Cl.
*F41B 11/53* (2013.01)

(52) U.S. Cl.
CPC ..... *F41B 11/53* (2013.01)

(58) Field of Classification Search
CPC ..... F41B 11/52; F41B 11/53; B65D 11/188; B65D 25/005
USPC ..... 220/810
See application file for complete search history.

(56) References Cited

U.S. PATENT DOCUMENTS 4,635,454 A * 1/1987 Brown ..... E05C 3/24 292/216
4,768,815 A * 9/1988 Harmon ..... E05C 19/145 292/113
5,166,457 A 11/1992 Lorenzetti
5,235,830 A * 8/1993 Benge ..... E05B 63/244 70/159
5,809,983 A 9/1998 Stoneking
5,954,042 A 9/1999 Harvey
6,220,237 B1 4/2001 Johnson et al.
6,327,953 B1 12/2001 Andresen
6,347,621 B1 2/2002 Guthrie
6,467,473 B1 10/2002 Kostiopoulos
6,481,432 B2 11/2002 Rushton et al.
(Continued)

FOREIGN PATENT DOCUMENTS

DE 876370 C 5/1953
DE 2035097 C2 8/1982
(Continued)

OTHER PUBLICATIONS

WARPIG—World And Regional Paintball Information Guide, http://www.warpig.com/paintball/technical/loaders/halo/index.shtml, Warpig.Com, Odyssey Readies Halo for Production, By Bill Mills, Jun. 2001, pp. 1 to 6.
(Continued)

*Primary Examiner* — Ernesto A Grano
*Assistant Examiner* — Symren K Sanghera
(74) *Attorney, Agent, or Firm* — Volpe Koenig

(57) ABSTRACT

A projectile loader is provided having a body split into two portions, a locking mechanism, a quick release carrier, and a retaining system. The locking mechanism is provided within the projectile loader for locking the two portions of the projectile loader body. The quick release carrier of a feed system is provided within the projectile loader for preventing jams, among other issues, within the projectile loader. The retaining system is provided within the projectile loader for ensuring the feed system remains secured within the body during use of the projectile loader.

12 Claims, 6 Drawing Sheets

(56) References Cited

U.S. PATENT DOCUMENTS

| | | | | |
|---|---|---|---|---|
| 6,526,955 | B1 | 3/2003 | Juan | |
| 6,644,293 | B2 | 11/2003 | Jong | |
| 6,722,355 | B1 | 4/2004 | Andrews, Jr. | |
| 6,742,512 | B1 | 6/2004 | Ho et al. | |
| 6,915,792 | B1 | 7/2005 | Sheng | |
| 7,000,603 | B1 | 2/2006 | Steenbeke | |
| 7,077,118 | B2 | 7/2006 | Lewis | |
| 7,096,513 | B1 * | 8/2006 | Kress | A42B 3/328 2/425 |
| 7,270,120 | B2 | 9/2007 | Broersma et al. | |
| 7,322,347 | B2 | 1/2008 | Broersma | |
| 8,047,191 | B2 | 11/2011 | Christopher et al. | |
| 8,235,030 | B2 | 8/2012 | Kaakkola et al. | |
| 8,387,607 | B2 | 3/2013 | Christopher et al. | |
| 8,746,225 | B2 | 6/2014 | Christopher et al. | |
| 8,857,658 | B2 | 10/2014 | Lin | |
| 8,985,378 | B2 | 3/2015 | Wan et al. | |
| RE45,490 | E | 4/2015 | Italia et al. | |
| 9,500,435 | B2 * | 11/2016 | Tseng | F41B 11/53 |
| 9,733,042 | B2 | 8/2017 | Yuen et al. | |
| 9,857,140 | B2 | 1/2018 | Italia | |
| 9,857,141 | B2 * | 1/2018 | Spurlock | F41B 11/71 |
| 10,502,520 | B2 | 12/2019 | Spurlock | |
| 11,796,280 | B2 * | 10/2023 | Pearce | F41B 11/53 |
| 11,919,704 | B1 * | 3/2024 | Sauer | B65D 11/188 |
| 11,933,576 | B1 * | 3/2024 | Pineda | F41B 11/71 |
| 2002/0020402 | A1 | 2/2002 | Kotsiopoulos | |
| 2002/0059927 | A1 | 5/2002 | Woods, Sr. | |
| 2006/0086347 | A1 | 4/2006 | Hedberg | |
| 2008/0017178 | A1 | 1/2008 | Marques et al. | |
| 2008/0047536 | A1 | 2/2008 | Chen | |
| 2011/0073092 | A1 | 3/2011 | Yeh | |
| 2012/0103316 | A1 * | 5/2012 | Kaakkola | F41B 11/57 124/51.1 |
| 2013/0015098 | A1 | 1/2013 | Chen | |
| 2013/0220293 | A1 | 8/2013 | Kaakkola | |
| 2021/0156641 | A1 * | 5/2021 | Pearce | F41B 11/52 |
| 2024/0271903 | A1 | 8/2024 | Pearce | |
| 2024/0425245 | A1 * | 12/2024 | Erickson | B25H 3/02 |

FOREIGN PATENT DOCUMENTS

| | | | |
|---|---|---|---|
| DE | 3721527 | C2 | 5/1989 |
| DE | 4343870 | A1 | 6/1994 |
| DE | 4343871 | C2 | 10/2000 |
| DE | 19922589 | A1 | 12/2000 |
| EP | 0075970 | B1 | 3/1985 |
| EP | 1054228 | A2 | 11/2000 |
| EP | 1653189 | B1 | 6/2010 |
| FR | 921527 | A | 5/1947 |
| GB | 470201 | A | 8/1937 |
| GB | 551077 | A | 2/1943 |
| GB | 2322438 | B | 1/1999 |
| JP | S5998806 | U * | 7/1984 |
| JP | H01179898 | A | 7/1989 |
| JP | 6325233 | B2 | 5/2018 |
| TW | M255391 | U | 1/2005 |
| WO | 1998013660 | A1 | 4/1998 |
| WO | 2001044745 | A1 | 6/2001 |
| WO | 2002042708 | A1 | 5/2002 |
| WO | 2003087698 | A1 | 10/2003 |
| WO | 2007033309 | A2 | 3/2007 |
| WO | 2007035601 | A2 | 3/2007 |
| WO | 2007044546 | A2 | 4/2007 |
| WO | 2007044822 | A2 | 4/2007 |
| WO | 2007098554 | A1 | 9/2007 |
| WO | 2008104061 | A1 | 9/2008 |
| WO | 2009009748 | A1 | 1/2009 |
| WO | 2009015393 | A2 | 1/2009 |

OTHER PUBLICATIONS

WARPIG—World And Regional Paintball Information Guide, http://www.warpig.com/paintball/technical/loaders/halo/review.shtml, Warpig.Com, Odyssey Halo By Bill Mills, Dec. 2001, pp. 1 to 7.

Odyssey Halo B Paintball Hopper Review, http://www.paintball-gun-review.com/hopper-reviews/odyssey-halo-b . . . , Paintball Gun Review, Odyssey Halo B Paintball Hopper Review, 2004 Paintball-Gun-Review.com, pp. 1 to 3.

www.ODYSSEYPAINTBALL.com, http://web.archive.org/web/20030205112543/http://www.odysseypain . . . , Odyssey Paintball Products, Understanding Halo B, pp. 1 to 3.

WARPIG—World And Regional Paintball Information Guide, http://www.warpig.com/paintball/technical/loaders/evlution/evlution . . . eVLution 2 Sneak Preview, by Bill Mills, Aug. 2001, p. 1 to 4.

WARPIG—World And Regional Paintball Information Guide, http://www.warpig.com/paintball/technical/loaders/evlution/index.shtml Brass Eagle's eVLution Loader, by Bill Mills, Aug. 2000, pp. 1 to 7.

WARPIG—World And Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 4.

Virtue Spire Paintball Loader Manual, Available at: https://pbmanuals.com/downloads/775_Virtue_Virtue_Spire_Hopper_Manual_ENG.pdf (2013).

Virtue Spire III Paintball Loader Manual, Available at: https://www.manualslib.com/manual/1709739/Virtue-Spire-lii.html (2012).

Valken V-Max Plus V4 Paintball Loader Owners Manual, Available at: https://valken-weblinc.netdna-ssl.com/media/W1siZilsljlwMjAvMDkvMjkvMTEvMjEvMjAvZGQyYmlxY2EtYTUxMi00NTU2LWE5NzEtMmlxM2NiNmYyMmQ5L1ZtYXhQbHVzLU1hbnVhbC12NC5wZGYiXV0/VmaxPlus-Manual-v4.pdf?sha=e962915fc26eb905 (2015).

Valken V-Max Manual, Available at: https://paintball.sklep.pl/public/assets/images/instrukcje/Valken%20V-max%20manual.pdf (2011).

Valken V-Max Plus Paintball Loader Owners Manual (2014).

WARPIG—World and Regional Paintball Information Guide http://www.warpig.comipaintballitechniceloadersilineup WARPIG Ballistic Labs Loader Speed Comparison, by Bill Mills, Sep. 2001, 8 pages.

VLOCITY Select Force View Loader Owners Manual, Sep. 2005, 4 pages.

* cited by examiner

PROJECTILE LOADER LOCKING AND OPERATION MECHANISMS

FIELD OF INVENTION

This invention relates to the field of projectile loaders, and more particularly, to a projectile loader having an internal locking mechanism and at least one retaining system positioned within the projectile loader.

BACKGROUND

Projectile loaders (otherwise known and used interchangeably herein as hoppers, magazines, or loaders) generally connect to projectile markers (compressed gas guns) and feed projectiles into the marker. Further, projectile loaders store projectiles and have an outlet or exit tube that is connected to an inlet tube (or feed neck) of the projectile marker, which is in communication with the breech of the marker. During normal operation, projectiles are dropped through the outlet tube of the projectile loader and into the projectile marker inlet tube. When the projectile at the bottom of a projectile stack within the inlet tube is dropped into the firing chamber of the projectile marker, it is replaced by the supply of projectiles remaining in the loader housing, thereby replenishing the stack. Thus, projectile loaders act to hold and feed projectiles into the breech of the projectile marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other suitable mechanism, such as those shown and described in U.S. Pat. Nos. 8,251,050; 6,213,110; 6,502,567; 5,947,100; 5,791,325; 5,954,042; 6,109,252; 6,889,680; 6,792,933, and U.S. Patent Publication No. US20210156641A1; the entire contents of all of which are incorporated by reference herein as is fully set forth. In "gravity feed" loaders, the loader has no moving parts, and projectiles fall into an outfeed tube by gravity. In "agitating" loaders, an agitator mixes projectiles so that no jams occur at the exit opening of the outlet tube. In "force feed" or "active feed" projectile loaders, the agitator or feeder (drive cone, carrier, paddle, or any other force feed drive system) forces projectiles through the exit tube. As the firing rates of projectile markers have increased, active feed loaders have become extremely popular due to their ability to ensure the proper feeding of projectiles to sustain the feed rates necessary to support today's markers.

It is often necessary for, by way of example, a projectile sport player to access the interior components of a projectile loader, for example to fix a jam. A player may also need to access components inside the body of the projectile loader, such as the agitators, control circuits, power supplies, sensors, and drive mechanisms. Moreover, if a projectile break inside the projectile loader, there must be a convenient and efficient way to open the body and clean the paint or dye from the inside of the projectile hopper, without having to fully disassemble the loader. Virtually all known solutions to the issue of accessing a projectile loader have focused on typical external release mechanisms such as push-buttons or latches. These have the drawback of being prone to damage, dirt, and debris, along with the possibility of accidental actuation during activity. Likewise, such external components add visual weight that detracts from the sleek aesthetic that players desire.

In addition, players are often very active during sport play, and may jump and/or dive up, over and around obstacles. In those situations, a multi-piece projectile loader could come apart, causing a disruption and potentially spilling projectiles.

Thus, there is the need for an openable projectile loader and feed system that overcomes the aforementioned problems and provides easy release of the loader while securely holding the components of the projectile loader together during high impact use of the projectile loader.

SUMMARY

According to one aspect, the present disclosure is directed to a projectile loader for a projectile marker (gun). The projectile loader can include a body, a locking mechanism, a lever, a lock, and a latch. The body can include an upper shell and a lower shell defining an interior volume within the body, the upper shell being moveable relative to the lower shell to transition between an open position and a closed position. The locking mechanism can be configured to selectively permit detach the upper shell from the lower shell. The locking mechanism can include the lever rotationally coupled to the upper shell. The lock can be fixedly coupled to the lower shell. A first locking feature of the lock can be configured to engage with a second locking feature of the lever when in a locked position. The latch can be positioned within the lower shell and translatable relative to the lock. An extension of the latch can engage with the lever to secure the locking mechanism in the locked position.

In one aspect, each of the lever, the lock, and the latch are positioned within a rear portion of the body of the projectile loader.

In one aspect, a catch couples the upper shell to the lower shell such that the upper shell is moveable relative to the lower shell to transition between the open position and the closed position In one aspect, a biasing member is positioned between an inner surface of the upper shell and the lever, such that the biasing member biases the second locking feature of the lever into engagement with the first locking feature of the lock.

In one aspect, the lever includes a protrusion extending from an outer surface of the lever on an opposite side of the lever as the second locking feature.

In one aspect, the extension of the latch includes a recess extending into an end of the extension.

In one aspect, the recess includes a complimentary mating shape with the protrusion of the lever.

In one aspect, the recess is engaged with the protrusion when the locking mechanism is in the locked position, and the recess is disengaged from the protrusion when the locking mechanism is in an unlocked position.

In one aspect, the latch is translated towards the lever to lock the locking mechanism, and the latch is translated away from the lever to unlock the locking mechanism.

In one aspect, the first locking feature of the lock is a hook-shaped locking feature, and the second locking feature of the lever is a hook-shaped locking feature.

In one aspect, the locking mechanism is disposed entirely within the interior volume of the body.

In one aspect, an opening is provided for loading projectiles into the projectile loader, the locking mechanism is only accessible via the opening.

According to another aspect, the present disclosure is directed to a projectile loader for a projectile marker (gun). The projectile loader can include a body, a feed system, a motor, and a carrier. The body can include an upper shell and a lower shell defining an interior volume within the body.

The feed system can be disposed within and coupled to the lower shell, the feed system can be configured to move projectiles within the projectile loader. The feed system can include the motor and the carrier. The motor can be coupled to a drive shaft, with the drive shaft being rotatable about an axis of rotation. The motor can be configured to cause the drive shaft to rotate about the axis of rotation. The carrier can be coupled to and configured to rotate with the drive shaft, the carrier being detachably coupled to the drive shaft.

In one aspect, a magnet detachably couples the carrier to the drive shaft.

In one aspect, the magnet and the drive shaft are each constructed from a ferrous stainless steel.

In one aspect, the magnet is positioned within a top neck of the carrier.

In one aspect, a central axis of the carrier is axially aligned with the axis of rotation of the drive shaft, and the carrier is positioned over and encompasses the drive shaft.

In one aspect, the feed system can include at least one assembly orientation indicator with a retaining tab positioned adjacent the assembly orientation indicator, the retaining tab being configured to be inserted into a retaining groove of the lower shell to ensure proper assembly of the feed system within the lower shell.

According to yet another aspect, the present disclosure is directed to a projectile loader for a projectile marker (gun). The projectile loader can include a body, a feed system, and a retaining system. The body can include an upper shell and a lower shell defining an interior volume within the body. The feed system can be configured to move projectiles within the projectile loader, and the feed system can be disposed within and detachably coupled to the lower shell. The retaining system can be disposed within and coupled to the lower shell. The retaining system can be configured to detachably couple the feed system to the lower shell such that the feed system is removeable from the lower shell as a single assembly feed system.

In one aspect, the retaining system comprises a first magnet fixedly coupled to an inner surface of the lower shell and a second magnet fixedly coupled to a lower surface of the single assembly feed system, and the first magnet and the second magnet detachably couple the single assembly feed system to the lower shell.

According to yet another aspect, the present disclosure is directed to a projectile loader for a projectile marker (gun). The projectile loader can include a body, a primary locking mechanism, and a secondary locking mechanism. The body can include an upper shell and a lower shell defining an interior volume within the body, the upper shell being moveable relative to the lower shell to transition between an open position and a closed position. The primary locking mechanism can be configured to selectively permit detaching the upper shell from the lower shell. The secondary locking mechanism can also be configured to selectively permit detaching the upper shell from the lower shell. The secondary locking mechanism can include a lever rotationally coupled to the upper shell. A lock can be fixedly coupled to the lower shell. A first locking feature of the lock can be configured to engage with a second locking feature of the lever when in a locked position. A latch can be positioned within the lower shell and translatable relative to the lock. An extension of the latch can engage with the lever to secure the locking mechanism in the locked position.

BRIEF DESCRIPTION OF THE DRAWING(S)

The foregoing Summary as well as the following Detailed Description will be best understood when read in conjunction with the appended drawings, which illustrate a preferred embodiment of the disclosure. In the drawings.

DETAILED DESCRIPTION OF THE PREFERRED EMBODIMENT(S)

Figure 1:
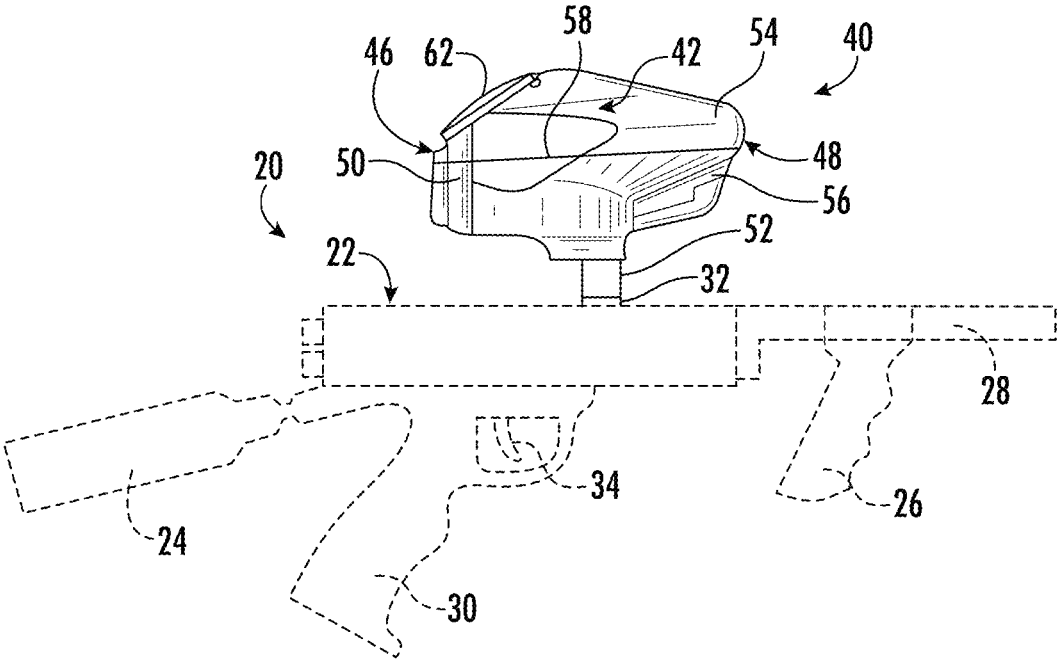
FIG. 1 is a side view of an exemplary projectile loader attached to a projectile marker (gun) shown in broken lines.

Certain terminology is used in the following description for convenience only and is not limiting. The words "front", "rear", "upper", and "lower" designate directions in the drawings to which reference is made. The words "inwardly" and "outwardly" refer to directions towards and away from parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terms "generally" and "approximately" are to be construed as within 10% of a stated value or ratio. The terminology includes the words specifically noted above, derivatives thereof, and words of similar import.

FIG. 1 is a side view of an exemplary projectile loader 40 attached to a projectile marker (gun) 20, illustrated in broken lines. The projectile marker 20 includes a main body 22, a compressed gas cylinder 24, a front handgrip 26, a barrel 28, and a rear handgrip 30. The projectile marker 20 also includes an inlet tube 32 leading to a firing chamber in the interior of the main body 22, and a trigger 34. The front handgrip 26 projects downwardly from the barrel 28 and provides an area for gripping by an operator of the projectile marker 20. The compressed gas cylinder 24 is typically secured to a rear portion of the projectile marker 20. The compressed gas cylinder 24 normally contains $CO_2$, although any compressible gas may be used.

A projectile loader 40 or "loader 40" (also referred to as a "feeder"), such as one which may be used for the present invention, includes a body 42 which houses an open interior volume 44, a rear end or rear portion 46, and a front end or front portion 48. In the illustrated example, the rear portion 46 is the end of the loader 40 that is positioned closest to a user of the projectile marker 20 during use of the projectile marker 20. The front portion 48 is the end of the loader 40 that is positioned furthest from the user of the projectile marker 20 during use of the projectile marker 20. The loader 40 may include an electronics portion 50 having control circuitry or electronics, which may include a microprocessor, for controlling various operating parameters of the loader 40. The lower portion of the projectile loader leads to an exit tube 52, which can also be referred to as an outfeed or feed neck. The exit tube 52 is coupled to the inlet tube 32 of the projectile marker 20, and the exit tube 52 communicates with the inlet tube 32 to supply projectiles to the projectile marker 20.

To operate the projectile marker 20, the trigger 34 is squeezed, thereby actuating the compressed gas cylinder 24 to release bursts of compressed gas. The bursts of gas propel and fire projectiles outwardly through the barrel 28. The projectiles are continually fed by the loader 40 through the inlet tube 32 to the firing chamber of the projectile marker 20 until the trigger 34 is released.

Figure 2:
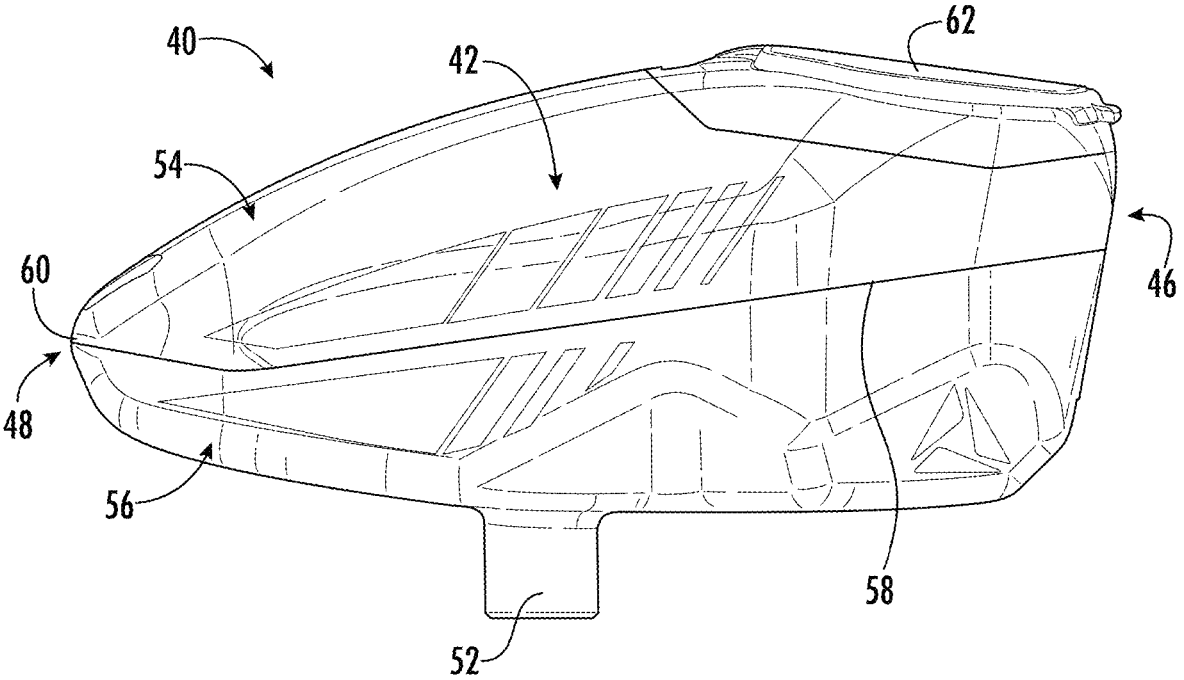
FIG. 2 is a side view of an exemplary projectile loader.

FIG. 2 is a side view of the exemplary loader 40 illustrated in FIG. 1. The loader 40 can include a body 42 including a rear portion 46 positioned at one end of the loader 40 and a front portion 48 positioned at a second, opposite end of the loader 40. Further, the body 42 can include an upper shell 54 and a lower shell 56 defining an interior volume 44 within the body 42. The upper shell 54 and the lower shell 56 can be constructed from a hard protective material and act as the outer case to store the projectiles. In the illustrated embodiment, each of the upper shell 54 and the lower shell 56 include a generally elliptical dome shape, and the upper shell 54 and the lower shell 56 abut and meet at a division seam 58. The division seam 58 is positioned at a generally central plane of the body 42, such that the upper shell 54 and the lower shell 56 each generally define a half of the body 42.

A catch 60 can be provided between the upper shell 54 and the lower shell 56, and the catch 60 can facilitate relative movement between the upper shell 54 and the lower shell 56. More specifically, the catch 60 facilitates coupling the upper shell 54 to the lower shell 56. In some examples, the catch 60 could be a hinge that allows the upper shell 54 to rotate toward and away from the lower shell 56 about an axis, to close and open the loader 40, respectively. In other examples, the catch 60 could be a hook or a clasp that couples the upper shell 54 to the lower shell 56, and a translating or sliding motion decouples the upper shell 54 from the lower shell 56. The catch 60 can be positioned along the division seam 58 between the upper shell 54 and the lower shell 56 and may be either external or internal to the body 42. Although the catch 60 is illustrated proximate the front portion 48 of the body 42, the catch 60 may alternatively be positioned anywhere along the division seam 58.

The loader 40 can further include a lid 62 coupled to a top or upper portion of the upper shell 54. In the illustrated embodiment, the lid 62 is coupled to a top of the upper shell 54 adjacent the rear portion 46 of the body 42. In other embodiments, the lid 62 can be positioned adjacent the front portion 48 or any other portion of the upper shell 54 of the body 42. The lid 62 is configured to cover and close an opening 64 (FIG. 3) that extends through the upper shell 54. The opening 64 allows a user to add projectiles into the loader 40. Further, the opening 64 allows the user to access the interior volume 44 of the loader 40. In addition, the lid 62 covers and closes off the opening 64 to prevent the projectiles from falling out of the loader 40 and to prevent foreign debris from entering the loader 40 during use.

In some examples, the lid 62 can be a two-piece component including an upper component and a lower component. The lower component of the lid 62 can include a plurality of openings or apertures, such that the interior of the loader 40 can be accessed through the openings. The upper component of the lid 62 can be completely closed off, such that the upper component of the lid 62 does not include any openings or apertures. The upper component of the lid 62 being completely closed off prevents rain or any other foreign debris from entering the interior volume 44 of the loader 40. In some examples, the upper component of the lid 62 can be a thin polymeric material that can be snap coupled to the lower component of the lid 62, such that the upper component of the lid 62 is coupled to the lower component of the lid 62, and the lower component of the lid 62 is rotationally coupled to the upper shell 54 of the body 42 through a hinge or other similar component/feature.

The lower shell 56 of the loader 40 includes an exit tube 52 extending from a lower surface of the lower shell 56. During use, the exit tube 52 is coupled to the inlet tube 32 of the projectile marker 20, and the exit tube 52 communicates with the inlet tube 32 to supply projectiles to the projectile marker 20.

Figure 3:
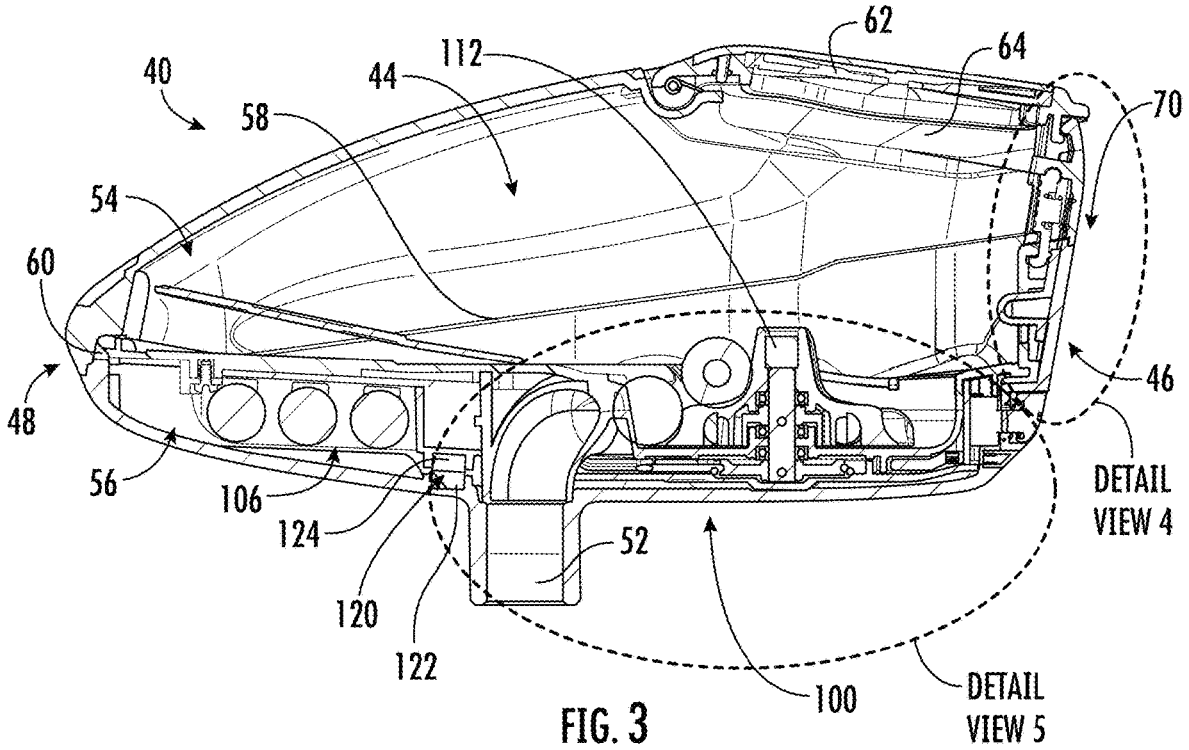
FIG. 3 is a side cross-sectional view of the exemplary projectile loader.

Referring to FIG. 3, the loader 40 can also include a locking mechanism 70, a feed system 100, and a retaining system 120, each of which can be positioned entirely within the interior volume 44 of the body 42 of the loader 40. As illustrated, the locking mechanism 70 is positioned entirely within the interior volume 44 of the body 42 adjacent the rear portion 46 of the loader 40. The feed system 100 is positioned entirely within the interior volume 44 of the body 42 adjacent a lower inner surface of the lower shell 56. In some examples, the feed system 100 can be described as being positioned adjacent and covering the exit tube 52 of the lower shell 56. The retaining system 120 is positioned entirely within the interior volume 44 of the body 42 adjacent a lower inner surface of the lower shell 56. Further, in some embodiments, the retaining system 120 can be positioned adjacent the exit tube 52 of the lower shell 56 and closer to the front portion 48 of the body 42 than the exit tube 52. Each of the locking mechanism 70, the feed system 100, and the retaining system 120 will be discussed in detail below.

Figure 4:
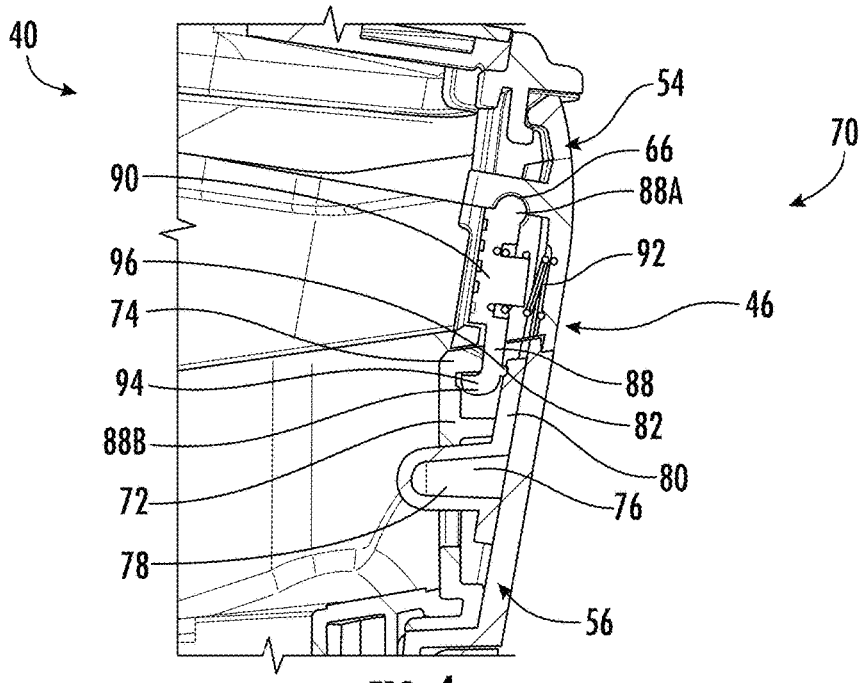
FIG. 4 is a magnified detail view of a rear portion of the projectile loader, as identified in FIG. 3.

FIG. 4 is a magnified detail view of the rear portion 46 of the loader 40, as identified in FIG. 3. Further, FIG. 4 is a detailed view of the locking mechanism 70 of the loader 40. The locking mechanism 70 is configured to selectively permit detaching the upper shell 54 from the lower shell 56. More specifically, when in the locked position (as shown in FIG. 4), the locking mechanism 70 is configured to securely couple the upper shell 54 and the lower shell 56 during use of the loader 40 and the projectile marker 20, preventing uncoupling of the upper shell 54 and the lower shell 56 during high impact events or scenarios. Further, after the locking mechanism 70 is transitioned from the locked position to the unlocked position, the locking mechanism 70 is configured to allow the separation and detaching of the upper shell 54 from the lower shell 56.

In some embodiments, as illustrated, the locking mechanism 70 includes at least a lock 72, a latch 76, and a lever 88. The lock 72 can be fixedly coupled to the lower shell 56 of the loader 40. In some embodiments, the lock 72 can be coupled to the lower shell 56 through one or more fasteners. In other embodiments, the lock 72 can be formed integral with the lower shell 56 such that the lock 72 and the lower shell 56 are a single monolithic component. The lock 72 is positioned entirely within the lower shell 56 and the lock 72 extends in a direction towards the upper shell 54. The lock 72 can include a first locking feature 74 disposed at a distal end of the lock 72 positioned closest to the upper shell 54. As illustrated, the first locking feature 74 of the lock 72 can include a generally hook-shape, and the open end/side of the hook-shape faces towards the rear portion 46 of the loader 40. More specifically, the hook-shape of the first locking feature 74 can include a generally vertical extending portion and a generally horizontal extending portion being generally perpendicular to the vertical extending portion. The generally horizontal extending portion of the hook-shaped first locking feature 74 is configured to engage with the lever 88 to secure the loader 40 in the locked position, discussed further below.

The latch 76 can be positioned within the lower shell 56, and the latch 76 can be translatable relative to the lower shell 56, the lock 72, and the lever 88. As illustrated, in some embodiments, the latch 76 can be positioned entirely within the lower shell 56. Further, the latch 76 can be positioned at least partially below the lock 72 and the lever 88, such that that latch 76 can be vertically lower than the lock 72 and the lever 88, according to the illustrated orientation. The latch 76 can include at least a knob 78, an extension 80, and a recess 82.

The knob 78 can be a protrusion or other projection that extends from the latch 76 towards the interior volume 44 of the body 42, in a direction away from the rear portion 46 of the body 42 and toward a front portion 48 of the body 42. The knob 78 is a component that is configured to provide a feature in which a user can interact with the latch 76 to translate (e.g., move, slide, push, press, transition, maneuver, or similar motions) the latch 76 vertically (as oriented in the Figures, or generally vertically) to lock and unlock the locking mechanism 70. In some embodiments, as shown best in FIGS. 6 and 7, the knob 78 can extend through a housing 84 (or wall) that encompasses the lock 72 and at least a portion of the latch 76. More specifically, the housing 84 can include a slot 86 extending through the housing 84, and the knob 78 can extend through the slot 86 of the housing 84. A user can reach through the opening 64 of the upper shell 54 and into the interior volume 44 of the loader 40, and then the user can grasp the knob 78 and translate the knob 78 of the latch 76 vertically (or generally vertically) to lock and unlock the locking mechanism 70, discussed further below.

Referring again to FIG. 4, the latch 76 can further include an extension 80 extending from the knob 78, and a recess 82 extending into an end of the extension 80. As illustrated, in some embodiments, the extension 80 can extend from the knob 78 in a direction generally parallel to the adjacent rear portion 46 of the lower shell 56. In some embodiments, the extension 80 can extend at an obtuse angle from the knob 78 in a direction towards the lever 88 and the upper shell 54. The recess 82 of the latch 76 is positioned near the end of the extension 80 positioned closest to the lever 88. Further, the recess 82 is positioned on the same lateral side of the latch 76 as the knob 78, such that the recess 82 faces in a direction towards the front portion 48 of the body 42. The recess 82 extends into an end side surface of the extension 80, such that the recess 82 is a cavity that extends into the extension 80. As shown best in FIG. 7, in some embodiments, the recess 82 can be a half or partial cylindrical cutout that extends from an outer surface of the extension 80 into the extension 80. In some embodiments, the recess 82 can include a complimentary mating shape with a protrusion 96 of the lever 88, discussed further below.

As illustrated in FIG. 4, with the loader 40 in the closed or locked position, the lever 88 is positioned partially within the upper shell 54 and partially within the lower shell 56. More specifically, the lever 88 is rotationally coupled at a first end 88A to the upper shell 54, and a second (opposite) end 88B of the lever 88 extends into the lower shell 56, when the loader 40 is in the locked position. The first end 88A of the lever 88 can include a rounded shape and the first end 88A can be coupled to a rounded cavity 66 within the upper shell 54. The rounded shape of the first end 88A and the rounded cavity 66 allow the lever 88 to rotate or pivot about an axis a specified distance or angle, defined by the geometry of the first end 88A and the rounded cavity 66. The lever 88 pivots about the axis to engage and/or disengage with the lock 72, discussed further below.

The lever 88 can include a button 90 positioned between the first end 88A and the second end 88B of the lever 88. A user can depress the button 90 to pivot or rotate the lever 88 about the pivot axis of the lever 88. The button 90 can be any solid surface that resists deformation when depressed by a user. In addition, a biasing member 92 can be provided that is disposed between the lever 88 and an inner surface of the rear portion 46 of the upper shell 54. The biasing member 92 can abut each of the inner surface of the upper shell 54 and the lever 88. The biasing member 92 can bias or force the lever 88 away from the inner surface of the upper shell 54 and towards the interior volume 44 of the loader 40, in a direction towards the front portion 48 of the body 42. As such, the lever 88 is biased toward the front portion 48 of the loader 40 until a user depresses the button 90 of the lever 88, causing the biasing member 92 to compress and allowing the lever 88 to rotate or pivot in a direction towards the rear portion 46 of the loader 40. In some examples, the biasing member 92 can be a spring.

A second locking feature 94 of the lever 88 is positioned at the second end 88B of the lever 88. Similar to the first locking feature 74 of the lock 72, the second locking feature 94 of the lever 88 can include a generally hook-shape. The open end/side of the hook-shaped second locking feature 94 faces towards the front portion 48 of the loader 40. More specifically, the hook-shape of the second locking feature 94 can include a generally vertical extending portion and a generally horizontal extending portion being generally perpendicular to the vertical extending portion. The generally horizontal extending portion of the hook-shaped second locking feature 94 is configured to engage the generally horizontal extending portion of the hook-shaped first locking feature 74 of the lock 72 to secure the loader 40 in the locked position. More specifically, the first locking feature 74 and the second locking feature 94 include complimentary mating shapes that are configured to engage when the locking mechanism 70 is in the locked position. Further, when the locking mechanism 70 is in the locked position, the first locking feature 74 and the second locking feature 94 prevent the upper shell 54 of the loader 40 from separating from the lower shell 56 of the loader 40.

The lever 88 further includes a protrusion 96 extending from an outer surface of the lever 88 on an opposite side of the lever 88 as the second locking feature 94. More specifically, the protrusion 96 of the lever 88 is positioned on the lateral side of the lever 88 that is closest to the rear portion 46 of the loader 40. In the illustrated embodiment, the protrusion 96 includes a half or partial cylindrical bump or projection that extends outwards from an outer surface of the lever 88. In some embodiments, the protrusion 96 can include a complimentary mating shape with the recess 82 of the latch 76. As such, and as illustrated, when the locking mechanism 70 is in the locked position, the protrusion 96 of the lever 88 is adjacent and abutting the recess 82 of the latch 76. Further, when the locking mechanism 70 is in the unlocked position, the protrusion 96 of the lever 88 is free from contact with the recess 82 of the latch 76.

The latch 76 of the locking mechanism 70 is a component that is configured to prevent the upper shell 54 from separating from the lower shell 56 during use of the loader 40. Specifically, the latch 76 prevents the upper shell 54 from separating from the lower shell 56 during a high-impact situation during use of the loader 40. When the latch 76 is translated vertically upwards (as shown in FIG. 4) towards the lever 88, the recess 82 of the latch 76 engages with the protrusion 96 of the lever 88, forcing the lever 88 towards the front portion 48 of the loader 40. Further, when the latch 76 is translated vertically upwards, the latch 76 prevents rotation of the lever 88 which in turn prevents the second locking feature 94 of the lever 88 from disengaging from the first locking feature 74 of the lock 72. Thus, the latch 76 ensures the first locking feature 74 of the lock 72 and the second locking feature 94 of the lever 88 remain coupled until a user translates the latch 76 vertically downwards away from the lever 88.

When the latch 76 is translated vertically downwards away from the lever 88, the recess 82 of the latch 76 disengages from the protrusion 96 of the lever 88. Due to the biasing force of the biasing member 92, the second locking feature 94 of the lever 88 remains engaged with the first locking feature 74 of the lock 72 until a user depresses the lever 88 towards the rear portion 46 of the loader 40. When the lever 88 is depressed, the lever 88 rotates about the pivot axis at the first end 88A and the biasing member 92 is compressed. This disengages the second locking feature 94 of the lever 88 from the first locking feature 74 of the lock 72, allowing separation of the upper shell 54 and the lower shell 56.

The locking mechanism 70 of the loader 40 ensures that the upper shell 54 and the lower shell 56 do not separate during high-impact situations when using the loader 40. A user can translate the latch 76 of the locking mechanism 70 vertically downward away from the upper shell 54 to unlock the locking mechanism 70. A user can translate the latch 76 of the locking mechanism vertically upward toward the upper shell 54 to lock the locking mechanism 70. The locking mechanism is only accessible from within the interior volume 44 of the body 42, preventing accidentally actuating the locking mechanism 70 when using the loader 40. Previous loaders include locking mechanisms accessible from the outside of the loader, which could be accidentally actuated when using the loader. As such, one skilled in the art will realize the advantages provided by the locking mechanism 70 of the loader 40.

It is to be understood that although the preceding disclosure is directed to the locking mechanism 70 being the main locking mechanism 70, in other examples, the locking mechanism 70 can be a secondary locking mechanism to a different and separate primary locking mechanism. For example, the primary locking mechanism could be the locking mechanism shown and described in U.S. Patent Publication No. US20210156641A1, the entire contents of which are incorporated by reference herein as is fully set forth, and the secondary locking mechanism could be the locking mechanism 70 as disclosed in the present application. As such, in an example according to the aforementioned (primary and secondary locking mechanisms), the (secondary) locking mechanism 70 can be utilized to ensure that the upper shell 54 and the lower shell 56 do not separate during high-impact situations when using the loader 40, even if the primary mechanism does disconnect or unlock for one reason or another. Therefore, in some examples, the loader 40 can include a primary and a secondary locking mechanism, as discussed above.

Figure 5:
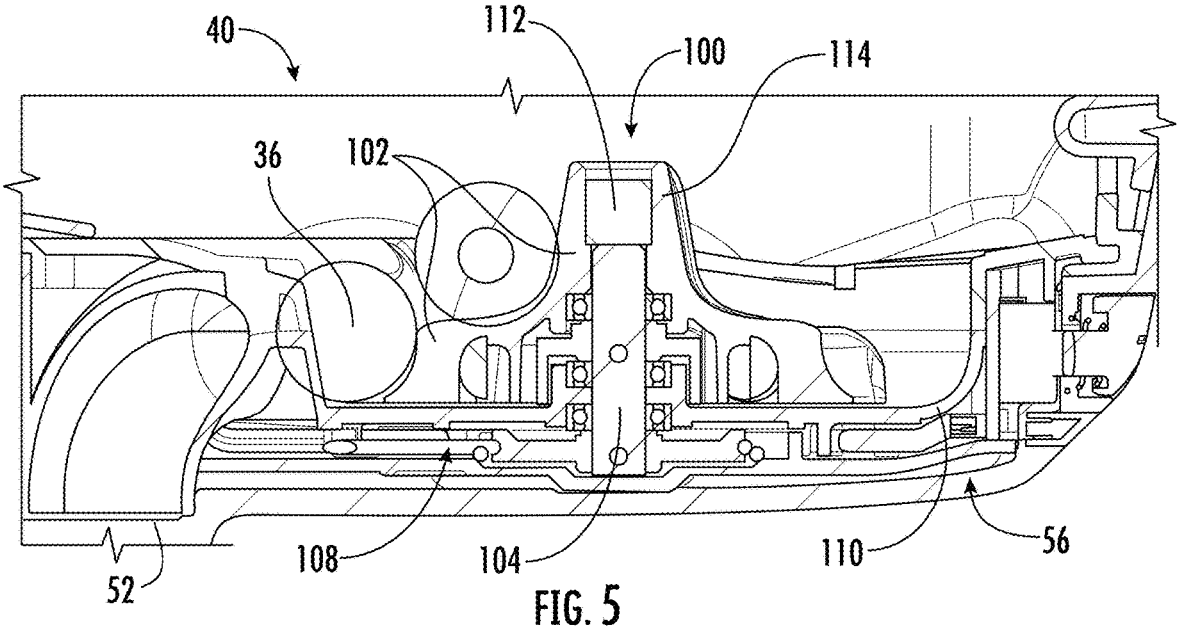
FIG. 5 is a magnified detail view of a bottom or lower portion of the projectile loader, as identified in FIG. 3.

Referring again to FIG. 3, the feed system 100 of the loader 40 is positioned entirely within the interior volume 44 of the body 42 adjacent a lower inner surface of the lower shell 56. In some examples, the feed system 100 can be described as being positioned adjacent and covering the exit tube 52 of the lower shell 56. As shown best in FIG. 5, the feed system 100 is generally used to drive, feed, move, or urge projectiles 36 toward the exit tube 52 and into the inlet tube 32 of the projectile marker 20 (FIG. 1). The feed system 100 preferably includes a carrier 102 positioned within the body 42 and coupled to a drive shaft 104. The drive shaft 104 can be coupled to a motor 106 (and in some examples a gear system 108) to drive projectiles 36 toward the exit tube 52. While an illustrative feed system 100 is shown, various other components may be substituted for driving projectiles 36 into the projectile marker 20. A catch cup portion 110 may house the carrier 102, and act as a reservoir or well where the projectiles 36 are held for feeding.

A variety of feed systems 100 and carriers 102 can be used in the present invention, including an impeller, drive cone, paddle wheel, fin, or other device which can direct or otherwise force or urge projectiles 36 into the exit tube 52. By way of example and not limitation, the carrier 102 may be used with a plurality of fins which extend in a radial direction from the central part of the carrier 102. It is appreciated that the carrier 102 may include recesses or pockets within which the projectiles 36 sit as they are shuttled toward the exit tube 52. The carrier 102 may be mounted on the drive shaft 104, which is connected to the motor 106, to rotate about a central axis of the drive shaft 104. As the motor 106 operates, the carrier 102 rotates, pushing projectiles 36 into the exit tube 52.

In some embodiments, as illustrated, the carrier 102 can be coupled to the drive shaft 104 such that the carrier 102 is positioned over and encompasses the drive shaft 104. Further, the carrier can be coupled to the drive shaft 104 such that a central axis of the carrier 102 is axially aligned with the central axis (axis of rotation) of the drive shaft 104. As such, the carrier 102 rotates about the axis of rotation of the drive shaft 104 during operation of the feed system 100. In some embodiments, the carrier 102 can be detachably coupled to the drive shaft 104, such that the carrier 102 can be grasped and pulled upwards by a user to detach and separate the carrier 102 from the drive shaft 104, for cleaning or other purposes.

In some embodiments, the carrier 102 can be detachably coupled to the drive shaft 104 through a magnetic connection. More specifically, a carrier magnet 112 can be positioned within and coupled to a neck 114 of the carrier 102. The neck 114 of the carrier 102 can be an elongated portion of the carrier 102 that extends vertically away from a lower surface of the lower shell 56 towards the upper shell 54. The carrier magnet 112 can be axially aligned with a central axis of the carrier 102 and/or the drive shaft 104, and the carrier magnet 112 can be fixedly coupled to the neck 114 of the carrier 102. The carrier magnet 112 can be magnetically attracted to the drive shaft 104 such that the carrier magnet 112 is magnetically attached to the drive shaft 104. In some examples, the drive shaft 104 can be constructed from a ferrous metal having magnetic properties, such that the carrier magnet 112 is magnetically attracted to the drive shaft 104. In other examples, the drive shaft 104 can include a drive shaft magnet (not shown) coupled to a distal end of the drive shaft 104 positioned closest to the neck 114 of the carrier 102, and the carrier magnet 112 can include an opposite polarity as the drive shaft magnet such that the carrier magnet 112 is magnetically attracted to the drive shaft magnet. In further examples, the drive shaft 104 could include the drive shaft magnet (not shown) and the carrier magnet 112 could be replaced with a ferrous metal component, such that the drive shaft magnet facilitates the magnetic connection between the carrier 102 and the drive shaft 104.

Therefore, the carrier 102 can be detachably coupled to the drive shaft 104 through magnetic attraction and a magnetic connection, using various approaches. During normal operation, the carrier magnet 112 of the carrier 102 abuts the drive shaft 104 (or the drive shaft magnet) and the carrier magnet 112 and the carrier 102 rotate with the drive shaft 104. The carrier 102 is detachably coupled to the drive shaft 104 such that the carrier 102 can detach and separate from the drive shaft 104 when desired, such that the carrier 102 no longer rotates with the drive shaft 104. The magnetically coupled carrier 102 is advantageous because it allows for a quick and easy connect and disconnect to and from the drive shaft 104, respectively. Further, the magnetically coupled carrier 102 is advantageous because during a feed system 100 jam the carrier 102 can be pushed away from the drive shaft 104 in an opposite direction as the jam or breach. As such, the magnetically coupled carrier 102 is easier on the projectiles within the loader 40, preventing breaking the projectiles 36 within the loader 40. Further, the magnetically coupled carrier 102 provides other advantages not specifically listed that will be appreciated by those skilled in the art.

Figure 10:
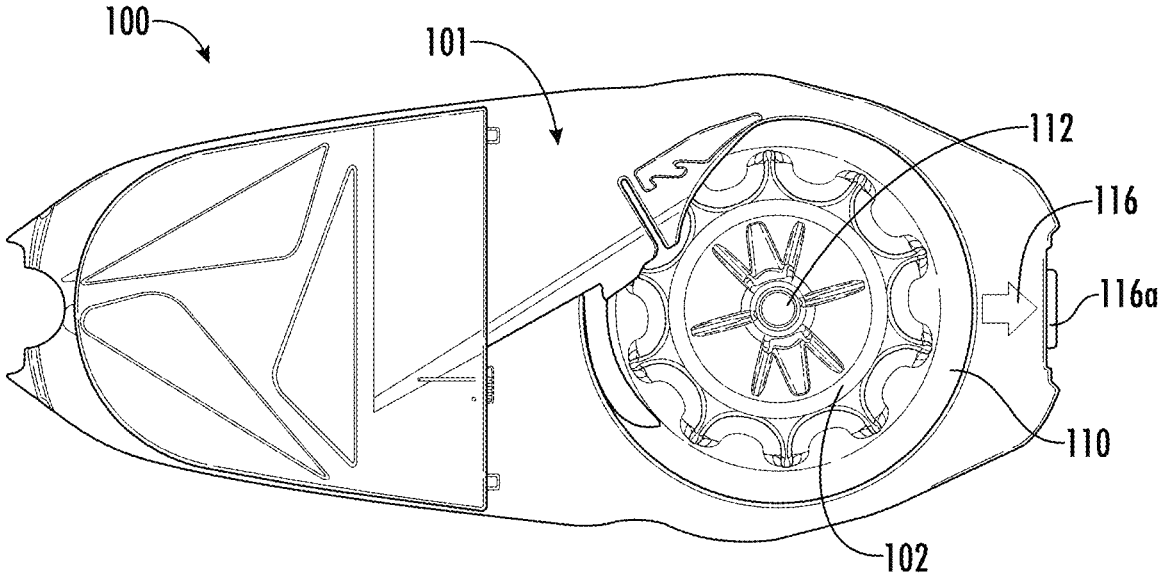
FIG. 10 is a top view of the feed system assembly, as identified in FIG. 8.
Figure 11:
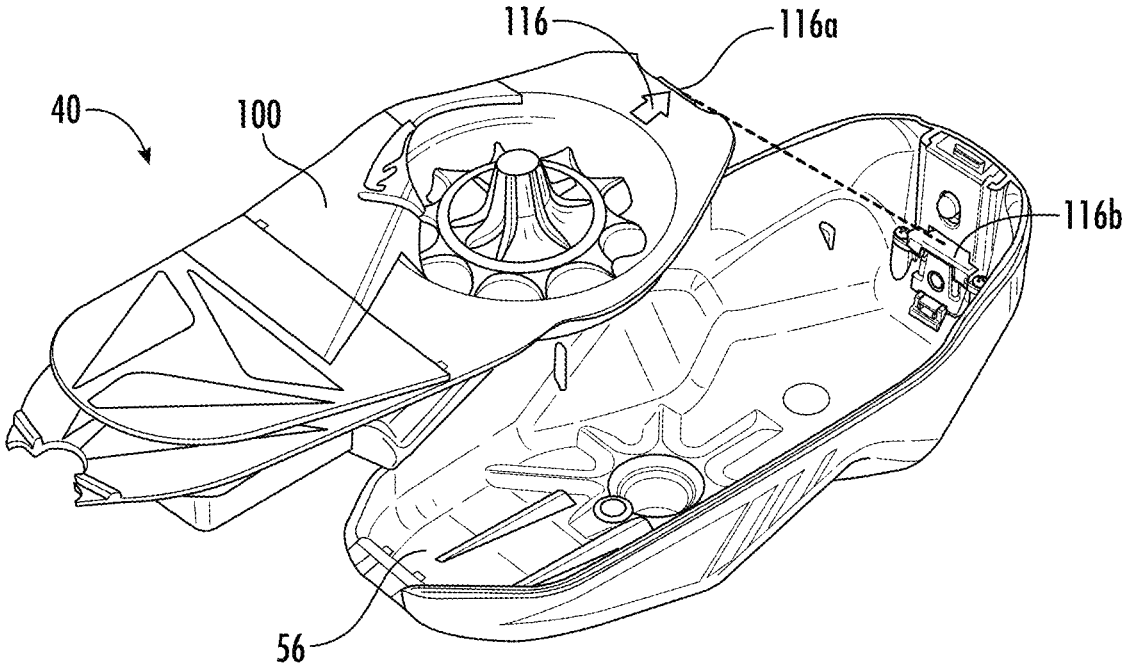
FIG. 11 is a perspective exploded view of the projectile load with the feed system removed from the lower shell.
Figure 12:
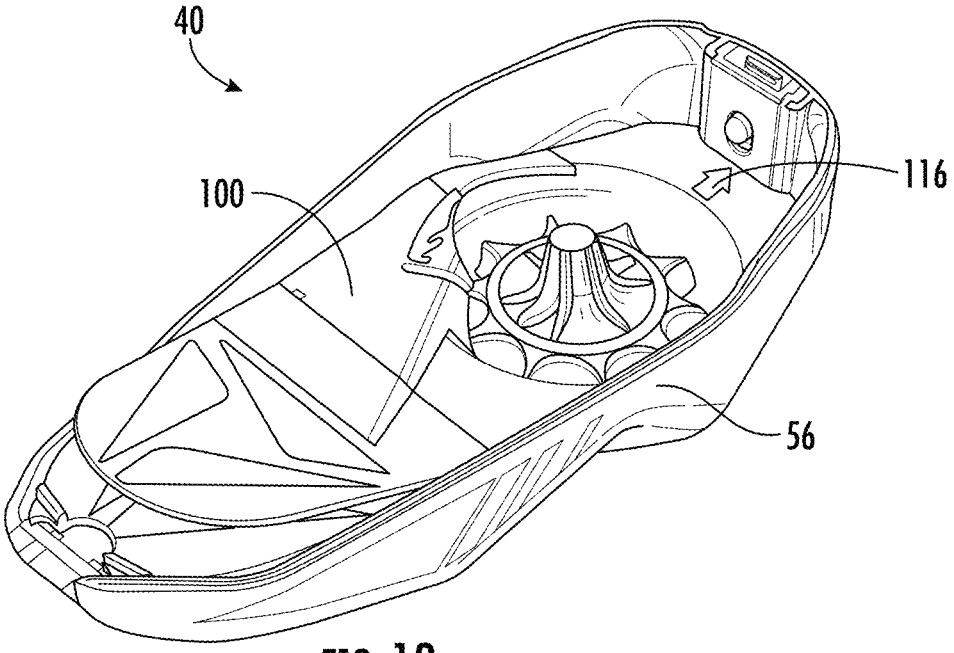
FIG. 12 is a perspective view of the projectile loader with the feed system installed in the lower shell.

Referring now to FIGS. 10-12, the carrier 102 can include at least one assembly orientation indicator 116, which helps ensure proper assembly of the feed system 100 within the lower shell 56. The at least one assembly orientation indicator 116 is disposed at the rear of the feed system 100 and on an upper surface of the feed system 100. As illustrated, in some examples the assembly orientation indicator 116 can be an arrow indicating which end of the feed system 100 is inserted into the lower shell 56 first and adjacent the locking mechanism 70. In other examples, the assembly orientation indicator 116 can be any marking or symbol, as desired. Positioned adjacent the assembly orientation indicator 116 can be a retaining tab 116*a*, which extends outwards from the feed system 100. In addition, the lower shell 56 can include a retaining groove 116*b* positioned below and adjacent the locking mechanism 70 that is configured to accept the retaining tab 116*b*.

To assemble the feed system 100 into the lower shell 56, a user positions the feed system 100 over the lower shell 56 at an angle with the nose or front end of the feed system 100 higher than the rear or aft end of the feed system 100. The user can then locate the assembly orientation indicator 116 and align the retaining tab 116*a*, positioned adjacent the assembly orientation indicator 116, with the retaining groove 116*b* of the lower shell 56. Next the user can insert the retaining tab 116*a* into the retaining groove 116*b* and then lower the remaining portions of the feed system 100 into the lower shell 56. The loader 40 includes features that help with self-aligning and securing the feed system 100 within the lower shell 56 during use, discussed in detail below.

Figure 6:
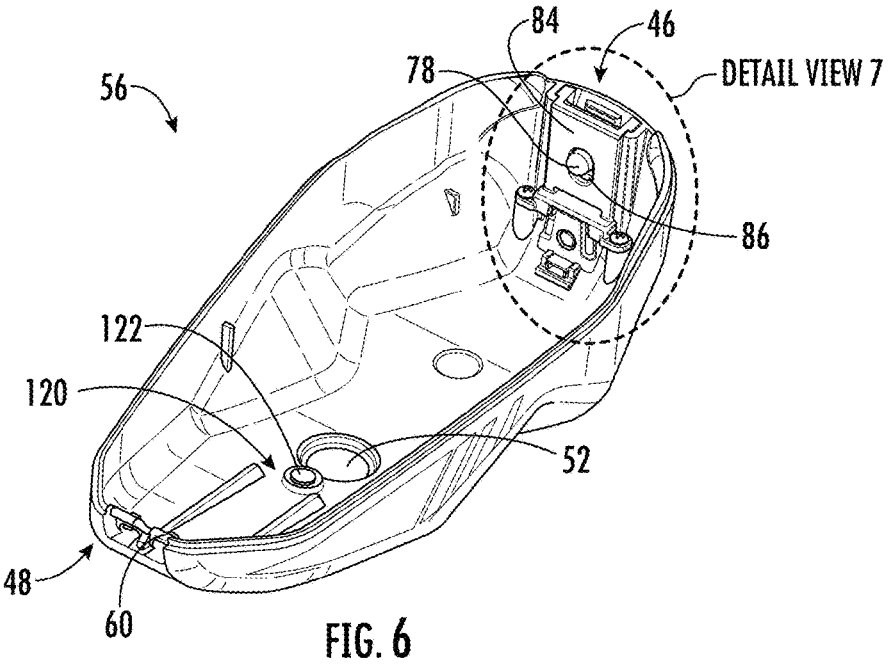
FIG. 6 is a perspective view of a lower shell of the exemplary projectile loader, with an upper shell and a feed system removed.
Figure 7:
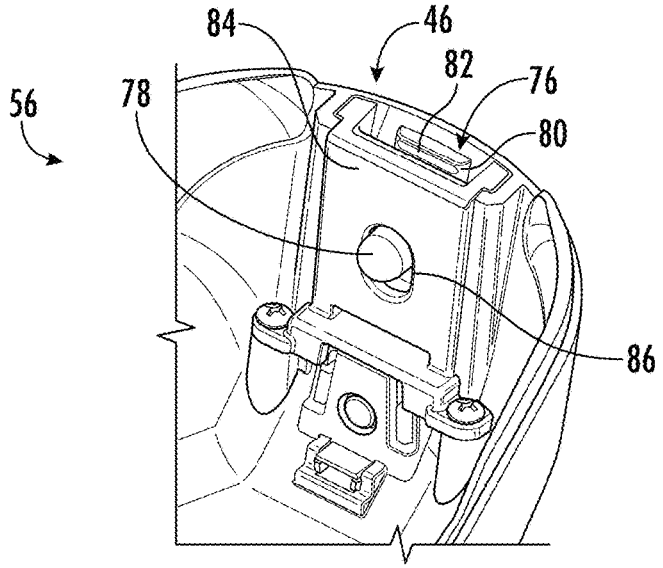
FIG. 7 is a magnified detail view of a rear portion of the lower shell, as identified in FIG. 6.
Figure 8:
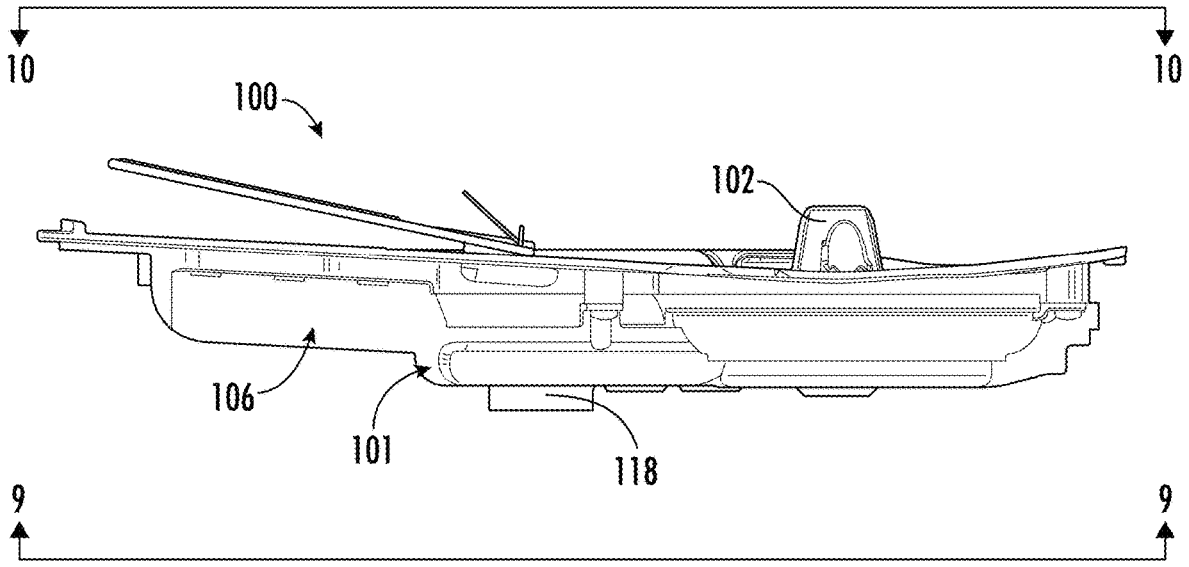
FIG. 8 is a side view of the feed system assembly of the exemplary projectile loader.
Figure 9:
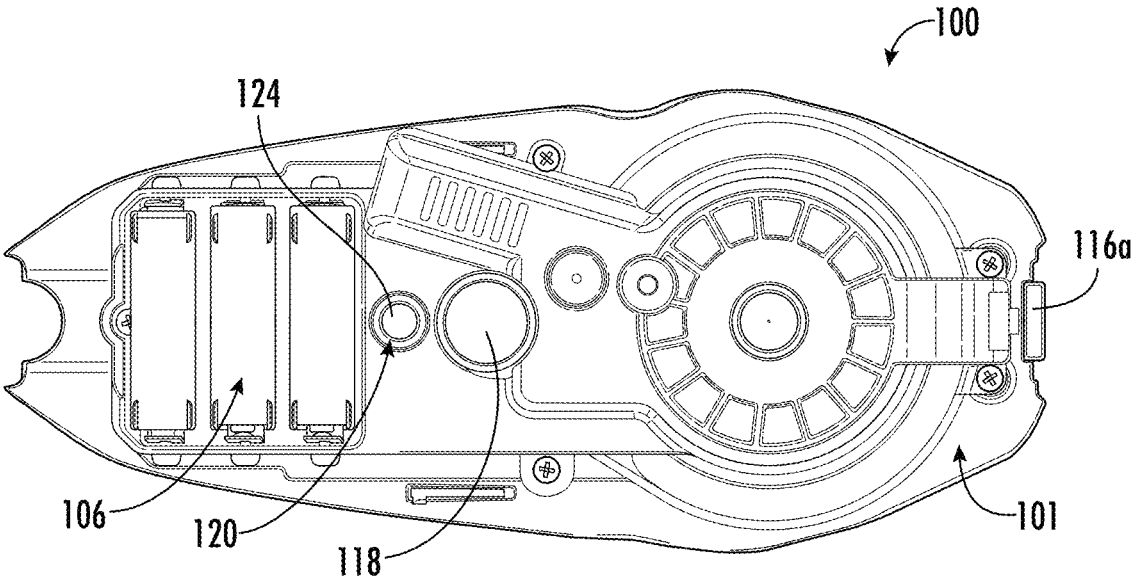
FIG. 9 is a bottom view of the feed system assembly, as identified in FIG. 8.

As shown best in FIGS. 3, 6, and 9, the loader 40 can include a retaining system 120 that is disposed within and coupled to the lower shell 56. The retaining system 120 is configured to detachably couple the feed system 100 to the lower shell 56. More specifically, as shown best in FIGS. 8-10, the feed system 100 can be constructed as a single assembly feed system 100 that can be inserted and removed from the lower shell 56 as a single unit or assembly. As such, each of the components of the feed system 100 can be positioned within a feed body 101, and the feed body 101 with all the other components of the feed system 100 is removable as a single unit or assembly.

As illustrated in FIG. 3, the retaining system 120 can include a first magnet 122 fixedly coupled to an inner surface of the lower shell 56, and a second magnet 124 fixedly coupled to a lower surface of the single assembly feed system 100. Referring to FIG. 6, in some embodiments, the first magnet 122 can be fixedly coupled to the lower shell 56 adjacent the exit tube 52 of the loader 40. Further, the first magnet 122 can be positioned between the exit tube 52 of the loader 40 and the front portion of the loader 40. Referring to FIG. 9, in some embodiments, the second magnet 124 can be fixedly coupled to the lower surface of the feed system 100 adjacent an exit tube 118 of the feed system 100. Further, the second magnet 124 can be positioned between the exit tube 118 of the feed system 100 and the front portion of the loader 40.

The first magnet 122 and the second magnet 124 of the retaining system 120 detachably couple the single assembly feed system 100 to the lower shell 56 of the loader 40. Magnetically coupling the feed system 100 to the lower shell 56 is advantageous because it allows for a quick and easy connect and disconnect of the components. Further, magnetically coupling the feed system 100 to the lower shell 56 is advantageous because the feed system 100 is removable from the lower shell 56 without the use or need for any type of tooling. In addition, magnetically coupling the feed system 100 to the lower shell 56 is advantageous because it prevents the feed system 100 from accidentally falling out of the lower shell 56 when the upper shell 54 has been unlocked and removed from the lower shell 56. Further, magnetically coupling the feed system 100 to the lower shell 56 provides other advantages not specifically listed that will be appreciated by those skilled in the art.

In the illustrated examples, the retaining system 120 includes a first magnet 122 and a second magnet 124 that include opposite polarity and are therefore magnetically attracted to each other. But it is to be understood that only one magnet (122 or 124) is required and the other magnet could be replaced with a ferrous metallic component that includes magnetic properties, such that the magnet is magnetically attracted to the ferrous metallic component. As such, in some examples both the first magnet 122 and the second magnet 124 are included to facilitate the magnetic connection. In other examples, the first magnet 122 is included and the second magnet 124 is replaced with a ferrous magnetic component, such that the first magnet 122 is magnetically attracted to the ferrous magnetic component to facilitate the magnetic connection. In another examples, the second magnet 124 is included and the first magnet 122 is replaced with a ferrous magnetic component, such that the second magnet 124 is magnetically attracted to the ferrous magnetic component to facilitate the magnetic connection. As such, in each of the disclosed examples, at least one magnet is provided to facilitate the magnetic connection between the components.

Having thus described the present embodiments in detail, it is to be appreciated and will be apparent to those skilled in the art that many physical changes, only a few of which are exemplified in the detailed description of the disclosure, could be made without altering the inventive concepts and principles embodied therein. It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the disclosure being indicated by the appended claims rather than by the foregoing description, and all alternate embodiments and changes to this embodiment which come within the meaning and range of equivalency of said claims are therefore to be embraced therein.

LOG OF REFERENCE NUMERALS

20 Projectile Marker
22 Main Body
24 Compressed Gas Cylinder
26 Front Handgrip
28 Barrel
30 Rear Handgrip
32 Inlet Tube
34 Trigger
36 Projectiles
40 Loader
42 Body
44 Interior Volume
46 Rear Portion
48 Front Portion
50 Electronics Portion
52 Exit Tube
54 Upper Shell
56 Lower Shell
58 Division Seam
60 Catch
62 Lid
64 Opening
66 Rounded Cavity
70 Locking Mechanism
72 Lock
74 First Locking Feature
76 Latch
78 Knob
80 Extension
82 Recess
84 Housing
86 Slot
88 Lever
88A First End
88B Second End
90 Button
92 Biasing Member
94 Second Locking Feature
96 Protrusion
100 Feed System
101 Feed Body
102 Carrier
104 Drive Shaft
106 Motor
108 Gear System
110 Cup Portion
112 Carrier Magnet
114 Neck
116 Assembly Orientation Indicator
116*a* Retaining Tab
116*b* Retaining Groove
118 Exit Tube
120 Retaining System
122 First Magnet
124 Second Magnet

What is claimed is:

1. A projectile loader comprising:
a body including an upper shell and a lower shell defining an interior volume within the body, the upper shell is attachable to and removable from the lower shell;
an exit tube extending from a lower surface of the lower shell, the exit tube being configured to supply projectiles to a compressed gas gun; and
a locking mechanism disposed within the interior volume, the locking mechanism being configured to selectively permit detaching the upper shell from the lower shell, the locking mechanism comprising:
a lever coupled to the upper shell;
a lock coupled to the lower shell, wherein a first locking feature of the lock is configured to engage with a second locking feature of the lever when in a locked position; and
a latch positioned within the lower shell and movable relative to the lock and the lower shell, wherein an extension of the latch engages with the lever to secure the locking mechanism in the locked position.

2. The projectile loader of claim 1, wherein each of the lever, the lock, and the latch are positioned within a rear portion of the body of the projectile loader.

3. The projectile loader of claim 1, wherein a catch couples the upper shell to the lower shell such that the upper shell is attached to the lower shell.

4. The projectile loader of claim 1, wherein a biasing member is positioned between an inner surface of the upper shell and the lever, such that the biasing member biases the second locking feature of the lever into engagement with the first locking feature of the lock.

5. The projectile loader of claim 1, wherein the lever includes a protrusion extending from an outer surface of the lever on an opposite side of the lever as the second locking feature.

6. The projectile loader of claim 5, wherein the extension of the latch includes a recess extending into an end of the extension.

7. The projectile loader of claim 6, wherein the recess includes a complimentary mating shape with the protrusion of the lever.

8. The projectile loader of claim 6, wherein the recess is engaged with the protrusion when the locking mechanism is in the locked position, and wherein the recess is disengaged from the protrusion when the locking mechanism is in an unlocked position.

9. The projectile loader of claim 1, wherein the latch is translated towards the lever to lock the locking mechanism, and wherein the latch is translated away from the lever to unlock the locking mechanism.

10. The projectile loader of claim 1, wherein the first locking feature of the lock is a hook-shaped locking feature, and wherein the second locking feature of the lever is a hook-shaped locking feature.

11. The projectile loader of claim 1, wherein the locking mechanism is disposed entirely within the interior volume.

12. The projectile loader of claim 1, further comprising an opening for loading projectiles into the projectile loader, wherein the locking mechanism is accessible via the opening.

* * * * *